US009476668B1

(12) United States Patent
Grace et al.

(10) Patent No.: US 9,476,668 B1
(45) Date of Patent: Oct. 25, 2016

(54) HYPERVELOCITY PROJECTILE LAUNCHING SYSTEM

(71) Applicant: ENIG ASSOCIATES INC., Bethesda, MD (US)

(72) Inventors: Fred Irvin Grace, York, PA (US); Yil Bong Kim, Silver Spring, MD (US); Eric N. Enig, Bethesda, MD (US)

(73) Assignee: ENIG ASSOCIATES INC., Bethesda, MD (US)

( * ) Notice: Subject to any disclaimer, the term of this patent is extended or adjusted under 35 U.S.C. 154(b) by 806 days.

(21) Appl. No.: 13/916,176

(22) Filed: Jun. 12, 2013

Related U.S. Application Data

(60) Provisional application No. 61/658,684, filed on Jun. 12, 2012.

(51) Int. Cl.
*F41F 1/00* (2006.01)
*F41B 6/00* (2006.01)

(52) U.S. Cl.
CPC ..... *F41B 6/003* (2013.01)

(58) Field of Classification Search
CPC ..... F41B 6/006; F41B 6/00; F41B 6/003; F41A 1/02
USPC ..... 89/8
See application file for complete search history.

(56) References Cited

U.S. PATENT DOCUMENTS 2,870,675 A * 1/1959 Salisbury ..... F41B 6/00 124/3
3,075,115 A * 1/1963 Flowers ..... F03H 1/0025 219/121.27
4,343,223 A * 8/1982 Hawke ..... H05H 1/54 124/3
4,854,215 A * 8/1989 Jasper, Jr. ..... F41B 6/006 124/3
4,870,888 A * 10/1989 Weldon ..... F41B 6/00 124/3
4,907,487 A * 3/1990 Tidman ..... F41B 6/00 124/3
4,913,029 A * 4/1990 Tidman ..... F41B 6/00 124/3
4,913,030 A * 4/1990 Reynolds ..... F41B 6/006 124/3
4,996,455 A * 2/1991 Loffler ..... F41B 6/00 124/3
4,997,047 A * 3/1991 Schroeder ..... E21B 7/26 175/162
5,024,137 A * 6/1991 Schroeder ..... F42B 6/006 124/3
5,105,713 A * 4/1992 Wirgau ..... F42B 6/006 102/517
5,168,118 A * 12/1992 Schroeder ..... F42B 6/006 124/3
5,223,662 A * 6/1993 Igenbergs ..... H05H 1/54 124/3

* cited by examiner

*Primary Examiner* — Samir Abdosh
(74) *Attorney, Agent, or Firm* — Browdy and Neimark, P.L.L.C.

(57) ABSTRACT

A gun system for launching a projectile that forms a component of a two-part payload that also includes a pusher that is separable from the projectile. The system includes a barrel, a source of propellant gas to propel the projectile and the pusher through the barrel, and a retarding coil and an accelerating coil, each having a coil axis parallel to the barrel axis and surrounding a projectile passage through the barrel, the retarding coil being disposed closer to the source of propellant gas than the accelerating coil. The retarding coil is configured to generate electromagnetic energy in response to passage of the pusher when being propelled by propellant gas ignition, and the accelerating coil is configured and coupled to impose an accelerating force on the projectile in response to the electromagnetic energy generated by the retarding coil.

6 Claims, 5 Drawing Sheets

HYPERVELOCITY PROJECTILE LAUNCHING SYSTEM

BACKGROUND OF THE INVENTION

The present invention relates to a novel flux compression generator suitable for achieving high velocity firing of projectiles.

Presently, there is a need to extend the range of, for example, 155 mm Cannons and 120 mm Mortars far beyond the current state-of-the-art ranges of 45 kilometers for artillery and 10 kilometers for mortars.

Traditionally, projectile muzzle velocity was achieved using the energy associated with the propellants acting on the projectile along the barrel length. [Army (February 1965), *Interior Ballistics of Guns*, Engineering Design Handbook: Ballistics Series, United States Army Materiel Command, AMCP 706-150]. Final velocity was limited by projectile mass, barrel length, propellant mass, and the ability of the breech and barrel to withstand internal pressure from propellant combustion. Further, muzzle velocity is limited by the sound speed of the propellant gases providing projectile acceleration. [Wikipedia.org/wiki/light_gas_gun: Light Gas Gun: Design Physics, 2013.]. Thus, regardless of the amount of propellant used, barrel strength or length, or diminishing projectile mass, projectile velocity exiting the muzzle is limited. With this limitation, a gun design efficiency diminishes correspondingly as the theoretical limit is approached, i.e., progressively more propellant energy is wasted.

For service use, generally, gun and mortar design utilize a range of aforementioned parameters to produce relatively low performance but efficient systems. As the demand for higher projectile velocity has increased to obtain greater range or improved hit probability for fast maneuvering targets, designs have moved toward higher muzzle velocity at the expense of efficiency. Some of the efficiency has been recouped through research providing more energetic propellants and igniters, and improved gun barrel materials, for example.

Higher projectile velocity providing extended range for artillery fire has been successfully achieved using rocket-assisted projectiles RAP. [General Dynamics Ordnance and Tactical Systems, 155MM M549A1 HE-RAP, www.gd-ots.com, 2013]. In these systems, payload is comprised of the projectile to be delivered on target plus the additional mass of the rocket. As such, only a relatively small projectile can be propelled to extended range. Further, cartridge case design is complex requiring additional igniters and timing mechanisms for the rocket portion of the payload. In addition, these systems are very inefficient in terms of the total propellant expended to achieve a given projectile velocity.

Research over the past twenty years or so has developed the possibility of electromagnetic launch of projectiles at hypersonic velocity using "rail gun" techniques. [Sofge, Erik (Nov. 14, 2007). "World's Most Powerful Rail Gun Delivered to Navy". Popular Mechanics, 2007]. As such, projectile velocity is not limited by conventional propellant sound speeds. While very high projectile velocities can be achieved, the launch systems generally are massive, and the launch phase has been plagued with electromagnetic erosion of sliding contacts and sabot materials that support the projectile during launch. In order to survive, the sliding contacts moving with the projectile have to be relatively massive, thus the projectile mass necessarily must be small to achieve hypersonic velocity. Further, the system requires a massive external generator such as a holopolar generator with magnetic braking, for example, as a power source. Also, the rail launch technique requires a completely new gun system and does not lend itself to integration into an existing howitzer or artillery cannons.

An additional approach has been a two-stage gun wherein the first stage is driven by conventional propellant while second stage is filled with light gas like helium that has higher sound velocity. [Wikipedia, supra]. Action of the propellant gases on an intervening diaphragm creates rupture that allows energy to compress the light gas with resulting force placed on the projectile base as it travels down the second stage barrel. With this system, projectile final velocity remains limited, but at a higher level. Such an approach increases the barrel length substantially and requires an external source of helium to recharge the second stage after each launch. This system is more massive and increases time interval between firings.

Projectile acceleration by a coil gun using single or multiple coils has been examined mainly to produce gun systems that do not rely on propellants. [Army Times: EM technology could revolutionize the mortar, 2011]. These systems also are not limited by propellant sound speeds. The power source is external and massive while fast acting and relatively massive switching devices are required. The more efficient higher performing coil guns contain multiple coils that require additional fast acting switches as the projectile passes from one coil to another. An advantage over rail gun is that little friction, if any, is present between the coil and projectile unlike the sliding contacts used in the rail gun launch technique. Power systems generally require a fast acting external homopolar generators or large capacitor banks.

Taking into account the complexities related to existing approaches for projectile launch at high velocity, the present invention overcomes many of these drawbacks. A direct application to gun and mortar systems is possible without modification to the gun structure supporting the gun breech and barrel or the gun breech itself. Modification to the barrel would be required. Otherwise the invention redistributes propellant energy loaded normally in the breech into electromagnetic energy for projectile acceleration to high velocity. Therefore, the invention has advantages in terms of utility, costs, simplicity and performance.

BRIEF SUMMARY OF THE INVENTION

According to the present invention, an extended projectile range may be obtained using electromagnetic energy together with existing propellants. Systems according to the invention are operative to utilize all of the propellant energy except heat to propel the final projectile at a higher velocity and with an extended range. The resulting projectile may also be rocket assisted for additional velocity and range. In operation, a system according to the invention arrests the propellant gas motion, and recoups its kinetic energy, and, through an electromagnetic coil system, transfers that energy to the projectile. Thus, the only loss experienced in transferring propellant energy to projectile kinetic energy is heat of propellant combustion. This technique would require a new cartridge case and barrel but otherwise could be adapted to existing gun system.

The concept according to the invention could be applied to mortars as well.

Presently, first order calculations have indicated that projectile velocities of 2.0 km/s can be achieved without rocket assist.

The present invention serves to propel projectiles at significantly higher velocity than current ordnance, even for high-mass projectiles. By way of example, a system according to the invention can launch a projectile having a mass of 10 kilograms with a muzzle velocity of 2 km/s.

The invention allows kinetic energy and/or high explosive munition effects to act on a target.

The invention provides a reduced time-of flight and high-velocity encounter with maneuvering targets.

The invention provides electromagnetic enhancement to utilize more energy from standard propellants.

The invention further allows the use of a standard breech without modification, a modified gun barrel to accommodate mechanisms, energy sources internal to the gun system, and a projectile system contained within a standard cartridge casing.

DETAILED DESCRIPTION OF THE INVENTION

Figure 1:
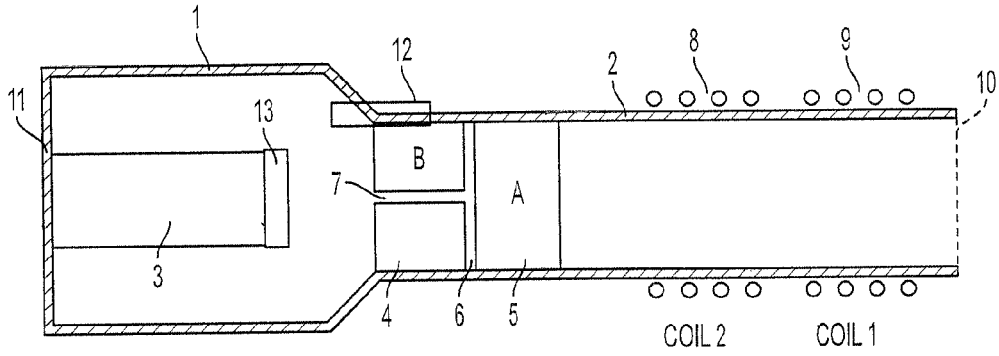
FIGS. 1 and 2 are schematic views of the basic components of a system according to the present invention.

FIG. 1 shows, in schematic form, the basic components of a system according to the invention for launching a projectile. The system includes a cartridge case 1 together with a barrel 2 having a muzzle end 10 and a breech end 11 in relation to cartridge case 1. The cartridge case 1 contains a propellant bed 3, a pusher plate 4 and a projectile 5. A separation 6 is established to maintain a space between pusher 4 and projectile 5. An interior orifice 7 can exist within pusher 4. A retarding coil 8 and an accelerating coil 9 are located along the length of barrel 2. Projectile 5 forms a two-piece payload together with pusher 4. Gun barrel 2 is modified to include the double coil system composed of coil 8, which will act as a magnetic brake and coil 9, which will act as a projectile accelerator.

At the breech end of barrel 2 and within cartridge case 1, a propellant 3 is provided to produce propellant gasses when ignited. Both projectile 5 and pusher 4 will be accelerated in gun barrel 2 by gases produced by ignition of propellant 3. Combustion of propellant 3 will expand to fill cartridge 1 and act on the rear surface of pusher 4, which in turn acts on projectile 5 to accelerate both down the barrel 2.

Projectile 5 and pusher 4 are either separated initially by separation 6 or will be separated by deliberate gas leakage through orifice 7 within pusher 4. Separation by either means allows pusher 4 and projectile 5 to separately enter the regions enclosed by coils 8 and 9, respectively, at appropriate times without interference. The magnetic braking action produced by coil 8 halts forward motion of pusher 4 at the location of coil 8 and therefore also blocks, or at least impedes, propellant gases attempting to flow down barrel 2. Projectile 5 is composed of ferromagnetic material, or conducting metals, or contains a coil to assist in the acceleration process.

The magnetic braking process converts the kinetic energy of pusher 4 and gases produced by ignited propellant 3 into electromagnetic energy in coil 8. This electromagnetic energy is converted into an electromagnetic accelerating force in coil 9, which force is applied to projectile 5 as it passes through coil 9 when projectile 5 is at the location of coil 9. To energize the braking process, a small amount of seed current supplied by a power module 12 that contains a disposal thermal battery and capacitor located internally within the cartridge 1. As an alternative, power module 12 could be located exterior to barrel 2 as exterior power module 13. This current seeds coil 8 after sufficient delay when projectile 5 clears coil 8 and a solenoid switch connects the seed capacitor to coil 8 through electrical connections that run through barrel 2.

Thus, coil 8 is energized after passage of projectile 5 but before pusher 4 reaches coil 8. The capacitor and solenoid remain intact during launch of pusher 4 and projectile 5 and are available for use on the next cartridge loading and firing sequence.

When power module 12 or 13 is used, an electrical signal is sent with ignition of the propellant 3 to the module. Power module 12 or 13 can contain a delay unit to provide proper delay before sending the seed current to coil 8. A means is provided to electrically connect the power module 12 or 13 to the igniter and to coil 8 through electrical leads either within cartridge 1 or barrel 2.

After ignition, the propellant gases accelerate the projectile/pusher system to the nominal velocity associated with a 155 mm gun system. An arrangement is made to create some space between projectile 5 and pusher 4 as the payload moves down barrel 2, as by providing passage 7 in pusher 4 that allows some propellant gas to flow past pusher 4 and then between pusher 4 and projectile 5. Coils 8 and 9 are located at two positions spaced widely apart along the barrel length but are connected electrically. Coil 8 and coil 9 are connected by electrical cables that run either within or on the exterior of barrel 2. Pusher 4 enters coil 8 and is magnetically braked to a stop, thereby also impeding flow of gasses produced by propellant 3. The magnetic braking generates energy in an electromagnetic field produced by coil 8. Subsequently, as pusher 4 is braked, projectile 5 acquires additional velocity by Lorentz forces as it passes through the region enclosed by coil 9. With a system according to the invention, there is no limitation regarding final projectile velocity in terms of sound speed of the gas since final velocity is obtained using magnetic or electromagnetic forces.

Figure 2:
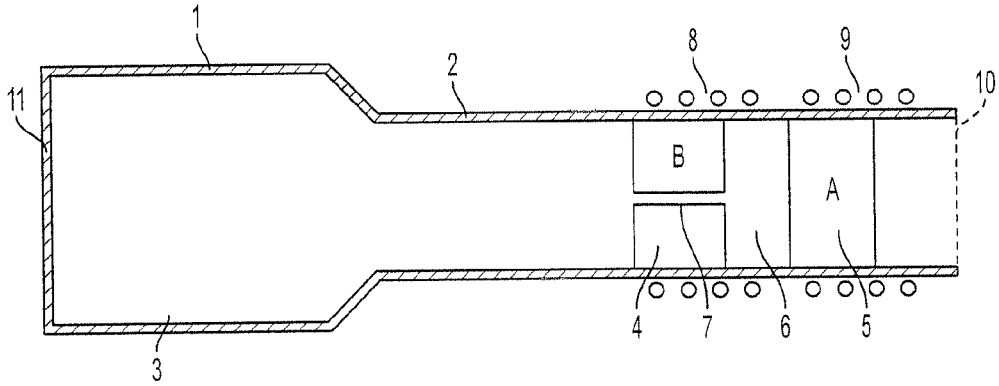

FIG. 2 shows the chamber of cartridge 1 and propellant 3 where propellant ignition, burn, gas expansion, and travel of pusher 4 and projectile 5 have progressed to the moment when pusher 4 and projectile 5 have moved down barrel 2 to the locations shown. Projectile 5 and pusher 4 have advanced to engage coil 9 and coil 8, respectively. Passage 7 has allowed gasses to fill separation 6 while the differential between the force on the base, or rear, sections of pusher 4 and that on the base, or rear, projectile 5 has produce an expanded separation 6. Thus, effects of magnetic compression by pusher 4 in coil 8 can mechanically act independently of action created by projectile 5 in coil 9. However, coil 9 and coil 8 are connected electrically.

Figure 3:
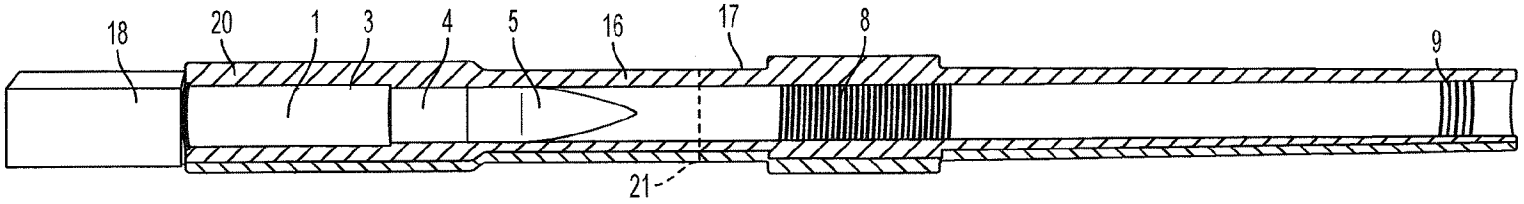
FIGS. 3-6 are pictorial views showing successive stages in the launching, or firing, of a projectile in a first embodiment of a system according to the present invention.

FIG. 3 shows gun system components that include steel gun breech 20, an initial portion 16 of the steel barrel, a composite barrel section 17, and a breech block 18. Breech 20 contains cartridge case 1 that in turn contains propellant bed 3, pusher 4, and projectile 5. Shown is a two-piece barrel configuration with interface 21 joining steel barrel 16 with composite barrel section 17. The aforementioned coil 8 and coil 9 are located at two positions along the length of the composite barrel section 17. The muzzle end of composite barrel section 17 can extend beyond coil 9 to assure complete acceleration of projectile 5.

Figure 4:
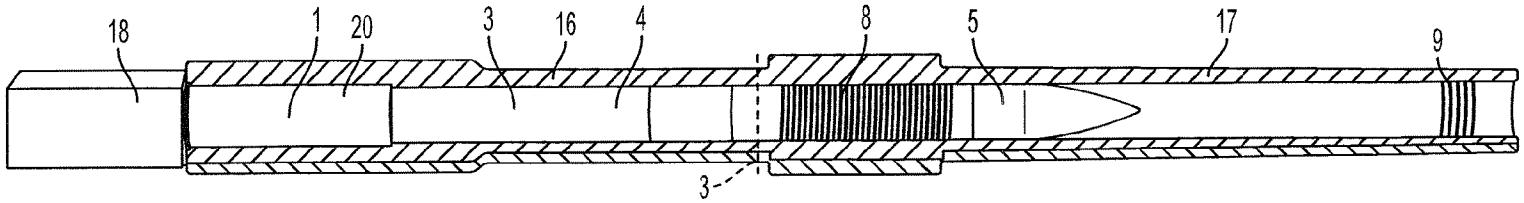

FIG. 4 depicts advancement of projectile 5 and pusher 4 in steel barrel 16 and composite barrel section 17, respectively. At this stage projectile 5 has separated from pusher 4 and has passed through coil 8 unimpeded since seed current has not yet been applied. As pusher 4 approaches coil 8 seed current is applied to coil 8, which establishes a magnetic field in that area. Further motion of pusher 4 into the region enclosed by coil 8 compresses the magnetic field and creates current and Lorentz forces that oppose forward motion of pusher 4.

Figure 5:
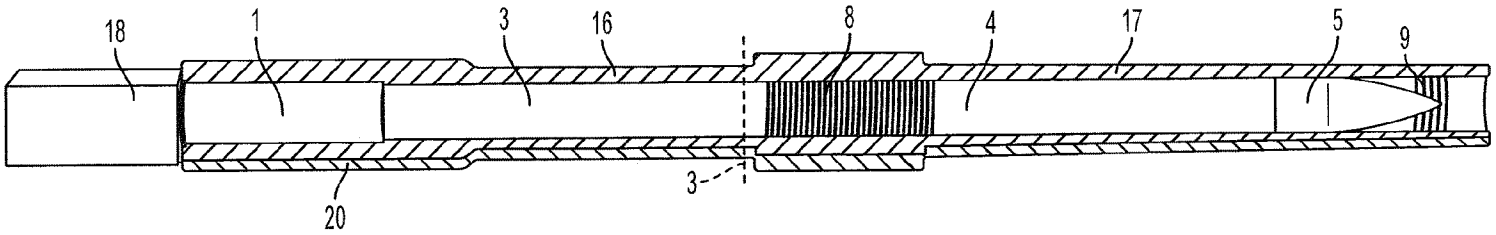

In FIG. 5, it is seen that the strength of the magnetic field produced by coil 8 is sufficient to stop the motion of pusher 4. Stopping of pusher 4 also stops, or at least impedes, gasses generated by combustion of propellant 3. Thus kinetic energy associated with pusher 4 and gasses of propellant 3 before stoppage is converted to electrical energy during the magnetic flux compression process that stops pusher 4. The electrical energy generated by the retarding coil 8 is now transmitted to acceleration coil 9 through connecting electrical conduits described previously. Coils 8 and 9 are separated by a gicen distance so that projectile 5 will reach the vicinity of coil 9 when the newly developed magnetic field produced by coil 9 can accelerate projectile 5.

Figure 6:
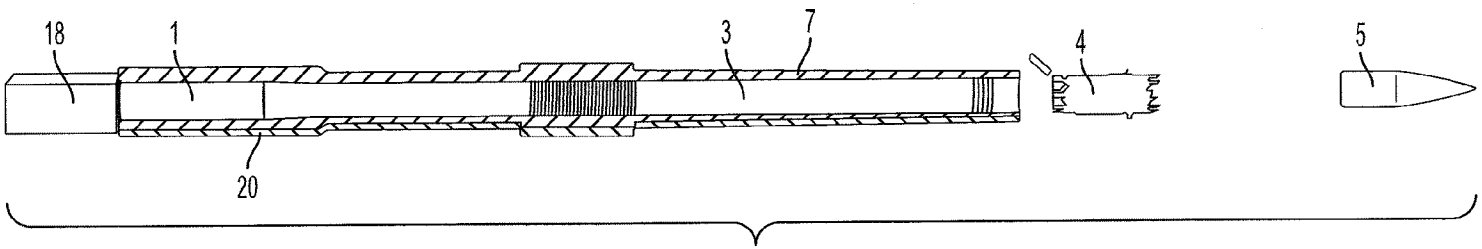

FIG. 6 shows the finally accelerated projectile 5 after exit of from the gun muzzle. After projectile 5 exits and magnetic field depletion occurs due to projectile 5 acceleration, pusher 4 is pushed out of composite barrel section 17. The pushing force comes from the residual pressure of gasses that had previously been trapped behind the stopped pusher 4. Pusher 4 is composed of a combination of ferromagnetic material or conducting metal and combustible or frangible material so that upon exit from barrel section 17, pusher 4 disintegrates. Once pusher 4 clears barrel section 17, the system is in a ready state for loading the next cartridge.

Figure 7:
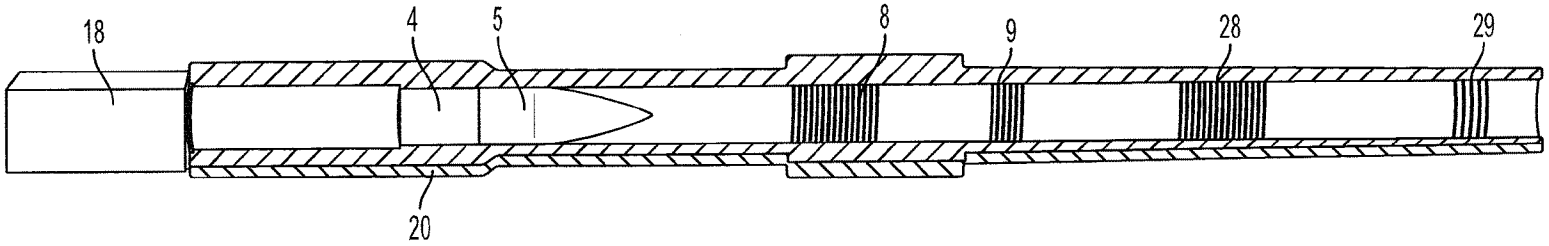
FIG. 7 is a pictorial view of a second embodiment of a system according to the present invention.

FIG. 7 illustrates a gun system that incorporates multiple coil pairs for accelerating projectile 5 and braking pusher 4. Multiple coils are used to improve the efficiency of the electromechanical system and as such many coil pairs could be used beyond the two sets shown in FIG. 7. As an example, pusher 4 can have its motion arrested by a series of coils such as coils 8 and 28, while projectile 5 can be accelerated in steps employing coils 9 and coil 29. Otherwise, the system operates as disclosed above.

Figure 8:
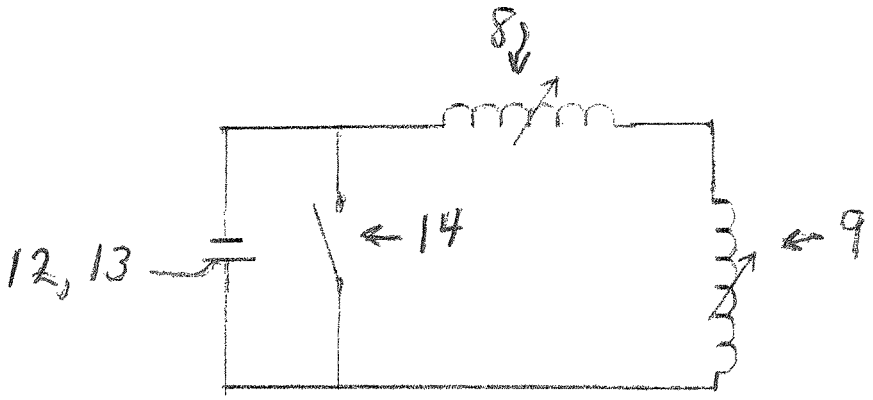
FIG. 8 is a schematic circuit diagram showing one exemplary connection arrangements for electrical components of a system according to the present invention.

FIG. 8 shows one example of the connection of coils 8 and 9 with power module, or seed current source, 12 or 13, and with a switch 14 that will be operated in initiation of a projectile launce, as by depressing a trigger. Switch 14 is initially closed to short-circuit module 12, 13 and is opened for a brief period to supply seed current to coil 8 at the appropriate time. After supplying the desired amount of seed current, switch 14 is again closed. Power module 12 or 13 and switch 14 together form a controllable current source.

Gun Energy Considerations

Application to Standard M101 Howitzer

For a conventional launch, both projectile and pusher as a single payload are accelerated initially to the muzzle velocity provided by the standard cartridge casing of an M101 gun system. An exemplary Gurney type calculation considers total payload mass of 19.08 kg, muzzle velocity of 472 km/s, and specific energy of 3 MJ/kg for the propellant charge. When the payload reaches the barrel muzzle, it is assumed that the propellant density is uniform along the interior of the breech/barrel length and that the gases have a linear velocity gradient, V, with position x along that length; zero at the back of the breech, where x=0, and $V_M$ just behind the projectile base $x=x_M$, where $x_M$ is the distance from the back of the breech chamber to the barrel muzzle, so that the propellant gas velocity at any point along the barrel is $vx=x/x_M V_M$. The mass density, m, at any point along x is constant and defined as $mx=Mc/x_M$, where Mc is the mass of the propelling charge. Then the total energy of the system, E, is $$E = \frac{1}{2}MpVm^2 + \frac{1}{2}\int_x^{xm} v(x)m(x)\,dx$$

where Mp is the payload mass. Thus, $$E = \frac{1}{2}MpVm^2 + \frac{1}{2}Mc\frac{Vm^2}{3} \text{ or } Vm = \sqrt{\frac{2E}{Mc}}\left(\frac{Mp}{Mc} + \frac{1}{3}\right)^{-\frac{1}{2}}$$

where E/Mc is the specific energy related to the propellant and considerably less than the burn energy Es=3 MJ/kg assumed here. The term √2E/Mc is the Gurney constant for the particular propellant under consideration. Defining a ratio, R1, between burn energy, Es, and specific energy in the gun system, E/Mc, then R1=(E/Mc)/Es and R1 is less than one, in general. Taking R1<1 for the propellant energy required to accelerate the payload, specifically R1=0.5, then a back calculation gives Mc=1.453 kg.

Now, for the electrical system according to the invention, the payload consists of pusher mass Mb and projectile mass Ma. In operation of a system according to the invention, magnetic forces stop pusher mass Mb and propellant gas mass Mc. Then the energy available to work on the coil system is that associated with those masses. Assuming that the coil system has an efficiency ratio of R2 in converting electrical energy to mechanical energy, the total available energy, Ea, to accelerate Ma beyond the muzzle velocity $V_M$ in the conventional case is $$Ea = \frac{1}{2}MpVm^2 + R_2\left(\frac{1}{2}MbVm^2 + \frac{1}{6}McVm^2\right) \text{ and } Va = \left(\frac{2Ea}{Ma}\right)^{\frac{1}{2}}$$

where Va is the muzzle velocity of the projectile being accelerated by electromagnetic forces. Results for R2=0.8 and constant Mb+Ma=19.08 kg are shown in the following Table. With this 105 howitzer system we can only accelerate 10 kg projectiles to approximately 625 m/s or 2 kg projectiles to 1400 m/s. Even so, this represents a significant gain over the conventional muzzle velocity of 472 m/s for the 105 howitzer.

| | | | | | | | | | | |
|---|---|---|---|---|---|---|---|---|---|---|
| Ma | 19.08 | 17.17 | 15.26 | 13.36 | 11.45 | 9.54 | 7.63 | 5.72 | 3.82 | 1.91 |
| Va | 472 | 495 | 523 | 557 | 599 | 653 | 727 | 836 | 1019 | 1436 |

A More Energetic Howitzer

The same analysis was used to determine requirements for a gun system that could accelerate a 10 kg projectile to 2 km/s using the same Gurney constant. For example, a case is shown for a gun that would be able to accelerate a 40.0 kg projectile to 990 km/s having 14.7 kg of propellant. Results are shown in the following Table.

| | | | | | | | | | | |
|---|---|---|---|---|---|---|---|---|---|---|
| Ma | 40.0 | 36.0 | 32.0 | 28.0 | 24.0 | 20.0 | 16.0 | 12.0 | 8.0 | 4.0 |
| Va | 990 | 1041 | 1103 | 1177 | 1269 | 1388 | 1551 | 1790 | 2194 | 3109 |

From the above table, notable examples are a 10 kg projectile with 2 km/s muzzle velocity or a 4 kg projectile at 3 km/s muzzle velocity. Thus, the present invention enables a 155 mm howitzer or artillery cannon to deliver substantial muzzle velocity beyond their current capability.

Flux Compression Physics

In the ideal case: coil 8 and coil 9 would have no electrical resistance and thus, to a first approximation, current amplification in the electrical system composed of coil 8 and coil 9 as a result of pusher entrance into coil 8 and projectile exit of coil 9 is $$(L_2+L_1)I_{seed}=(L_2(t)+L_1(t))I(t),$$

where $L_2$ is the inductance of coil 8 before pusher entrance, $L_1$ is the inductance of coil 9 before projectile entrance, $I_{seed}$ is the seed current applied to coil 8 and t is the time after propellant gas ignition. During pusher and projectile motion, the inductances of the coils change. Under these conditions, the energy/current gain from retarding coil 8 and accelerator coil 9 is:

$$G_{current}=G_{energy}=(L_2(0)+L_1(0))/(L_2(t)+L_1(t))$$

$$G_{max}=(L_2(0)+L_1(0))/L_{1min}$$

where 0 is the time just before pusher and projectile entrance into their respective coils.

By way of example, for a 105 mm diameter system, $L_1$=200 μH (100 turns), $L_{1min}$=0.01 μH, $G_{max}$=20000.

For a 3 kA seed current, initial energy=$L_1^2$=1.8 kJ, and final energy=36 MJ. The final energy comes from the kinetic energy of the pusher and moving propellant gases before being braked. Because of system losses, the gain, $G_{max}$, will be reduced to an actual gain, $G_A$, by an exponential factor α~0.85, so that $G_A=G_{max}^{\alpha}$, and thus actual gain is 4500 and coil gun efficiency is much lower than 100%.

The energy required to accelerate a 10 kg projectile from 1 km/s to 2 km/s is 15.0 MJ. By illustration, a ballistics calculation demonstrates capabilities of the present invention:

Assumption 1: 50% efficiency from specific energy 3 MJ/kg of propellant charge to the kinetic energy of projectile and propellant.

Assumption 2: 80% coil gun efficiency from EM energy of coil to accelerated projectile energy.

In the 30 kg and 35 kg pusher mass examples, a 15 kg propellant charge can accelerate 10 kg projectile to 2 km/s and a 5 kg projectile to 3 km/s muzzle velocity.

| | | | | |
|---|---|---|---|---|
| Pusher mass | 0 kg | 20 kg | 30 kg | 35 kg |
| Projectile mass | 40 kg | 20 kg | 10 kg | 5 kg |
| Muzzle velocity | 990 m/s | 1388 m/s | 1994 m/s | 2979 m/s |

For the 5 kg example, retarding coil needs a seed current of ~5 kA, then energies involved are:

Specific energy of 15 kg propellant~45 MJ

EM energy in accelerator coil~22.5 MJ

Kinetic energy to accelerate 5 kg projectile from 1 to 3 km/s~20 MJ

A system according to the invention requires only modification of the gun barrel to accommodate the coils. The system can utilize a standard cartridge case and breech.

The final projectile velocity is acquired from the total energy of propellant gases, except for heat, but utilizes otherwise wasted kinetic energy of escaping gases.

No external energy source required but implementation of the technique allows for external energy sources for seed current generation.

Pusher and projectile will be fabricated from ferromagnetic materials, and/or conducting metals, and/or will contain internal coils to enhance acceleration by electromagnetic energy.

Pusher may be made of combustible or frangible material to reduce down range hazards.

Magnetic pressure can be contained within the barrel.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A gun system for launching a projectile that forms a component of a two-part payload that also includes a pusher, said system comprising:

a barrel having a front end and a rear end and delimiting a projectile passage that extends from said rear end to said front end, said barrel being constructed to initially hold the projectile at a location adjacent said rear end and hold the pusher between the projectile and said rear end;

a source of propellant gas coupled to said rear end of said barrel such that the propellant gas will propel the projectile and the pusher along in a direction from said rear end toward said front end; and a first retarding coil and a first accelerating coil, each associated with said barrel and each having a coil axis parallel to said longitudinal axis and surrounding said projectile passage, said first retarding coil being disposed at a location between the location where the projectile is initially held and said front end of said barrel and said first accelerating coil being disposed at a location between said first retarding coil and said front end of said barrel, wherein said first retarding coil is configured to generate electromagnetic energy in response to passage of the pusher when being propelled by propellant gas, and said first accelerating coil is configured and coupled to impose an accelerating force on the projectile in response to the electromagnetic energy generated by said first retarding coil.

2. The system of claim 1, wherein the pusher and the projectile are each made of a ferromagnetic material, or a conductive metal, or contain an interactive coil.

3. The system of claim 1, where the barrel is composed of two sections, including a first section of steel or standard material and a second section composed of a composite material transparent to magnetic fields.

4. The system of claim 1, wherein the pusher is composed of at least one of a ferromagnetic material and conducting metal in a composite mixture with combustible or frangible material.

5. The system of claim 1, further comprising a second retarding coil and a second accelerating coil located between said first accelerating coil and said front end of said barrel to impose a further accelerating force on the projectile, with said second accelerating coil being disposed at a location between said second retarding coil and said front end of said barrel.

6. The system of claim 1, further comprising a power module connected for producing a seed current for activating said first retarding coil.

* * * * *